US010377610B2

(12) United States Patent
Chen et al.

(10) Patent No.: US 10,377,610 B2
(45) Date of Patent: Aug. 13, 2019

(54) LINEAR LIFTING DEVICE

(71) Applicant: BenQ Medical Technology Corporation, Taipei (TW)

(72) Inventors: Yuan-Chen Chen, Taipei (TW); Chih-Ching Hu, Taipei (TW)

(73) Assignee: BenQ Medical Technology Corporation, Taipei (TW)

( * ) Notice: Subject to any disclaimer, the term of this patent is extended or adjusted under 35 U.S.C. 154(b) by 337 days.

(21) Appl. No.: 15/594,731

(22) Filed: May 15, 2017

(65) Prior Publication Data

US 2017/0334694 A1 Nov. 23, 2017

(30) Foreign Application Priority Data

May 20, 2016 (TW) ..... 105115766 A

(51) Int. Cl.
*B66F 3/46* (2006.01)
*B66F 3/44* (2006.01)
*G05G 23/02* (2006.01)

(52) U.S. Cl.
CPC ..... *B66F 3/46* (2013.01); *B66F 3/44* (2013.01); *G05G 23/02* (2013.01); *B66F 2700/09* (2013.01); *G05G 2700/02* (2013.01)

(58) Field of Classification Search
CPC ..... B66F 3/46; B66F 3/44
USPC ..... 187/213, 277
See application file for complete search history.

(56) References Cited

U.S. PATENT DOCUMENTS 2,624,546 A * 1/1953 Haumerson ..... B66F 7/02 187/204
3,002,588 A * 10/1961 Charpigny ..... B66F 7/04 187/213
5,427,471 A * 6/1995 Godbersen ..... B63C 3/06 114/48
5,580,206 A * 12/1996 Redelman ..... B66F 9/07 187/213
5,772,360 A * 6/1998 Wood, II ..... B63C 3/06 114/48

(Continued)

FOREIGN PATENT DOCUMENTS

JP 2008214056 A 9/2008

OTHER PUBLICATIONS

Office action of counterpart application by Taiwan IP Office dated May 12, 2017.

*Primary Examiner* — David S Warren

(57) ABSTRACT

A linear lifting device including a lifting column, a synchronous adjusting mechanism, a first motion element and a second motion element is provided. The lifting column has a fixed end and a movable end. The synchronous adjusting mechanism, disposed on the movable end, has a first force-bearing end and a second force-bearing end, which are respectively separated from the center of the synchronous adjusting mechanism by a rotating radius and remain at a synchronous state. The first and second elements respectively connect the first and second force-bearing ends for generating a first force to push the first force-bearing end to move in a first force direction and generating a second force to push the second force-bearing end to move in a second force direction, such that the movable end can move with respect to the fixed end in a resultant force direction of the first and second force directions.

20 Claims, 6 Drawing Sheets

(56) References Cited

U.S. PATENT DOCUMENTS

| | | | | |
|---|---|---|---|---|
| 6,817,449 | B2 * | 11/2004 | Berends | B66F 7/20 187/213 |
| 6,863,159 | B2 * | 3/2005 | Rauch | B66F 7/02 187/206 |
| 8,944,737 | B2 * | 2/2015 | Black | E04B 1/3522 254/89 H |
| 10,173,873 | B2 * | 1/2019 | Horimizu | B66F 7/28 |
| 2002/0023801 | A1 * | 2/2002 | Rauch | B66F 7/02 187/210 |
| 2004/0011594 | A1 * | 1/2004 | Stewart | B66F 7/28 187/213 |
| 2008/0116012 | A1 * | 5/2008 | Ferguson | B60P 3/36 187/213 |
| 2011/0008135 | A1 * | 1/2011 | Black | E04B 1/3522 414/10 |
| 2017/0334694 | A1 * | 11/2017 | Chen | B66F 3/44 |
| 2018/0339890 | A1 * | 11/2018 | Perlstein | B66F 3/46 |
| 2018/0354760 | A1 * | 12/2018 | Elliott | B66F 3/46 |

* cited by examiner

LINEAR LIFTING DEVICE

This application claims the benefit of Taiwan application Serial No. 105115766, filed May 20, 2016, the subject matter of which is incorporated herein by reference.

BACKGROUND OF THE INVENTION

Field of the Invention

The invention relates in general to a linear lifting device, and more particularly to a linear lifting device having a synchronous adjusting mechanism.

Description of the Related Art

In comparison to the hydraulic linear motion element, the electric linear motion element, having a larger volume, can only be disposed on one side or two opposite sides of the lifting column and cannot be disposed at the center of the lifting column. However, when the electric linear motion element is disposed on one side of the lifting column, the pushing force is insufficient. Furthermore, the resistance caused by the lateral force directly affects the maximum output power, and the lifting column will take a longer time to ascend or descend.

When both sides of the lifting column have an electric linear motion element disposed thereon, the pushing force will be increased. However, displacement error (such as potential error or mechanic error) may easily occur if the two electric linear motion elements are not synchronized. Moreover, the lateral force will generate pendulum effect, making the lifting column to swing left and right or forward and backward. Therefore, it has become a prominent task for the industries to resolve the above problems.

SUMMARY OF THE INVENTION

The invention is directed to a linear lifting device. Through the coordination of a synchronous adjusting mechanism, two or multiple motion elements, despite having displacement error, still can move upward or downward synchronously, and pendulum effect caused by the lateral force can thus be reduced.

According to one embodiment of the present invention, a linear lifting device including a lifting column, a synchronous adjusting mechanism, a first motion element and a second motion element is provided. The lifting column has a fixed end and a movable end. The synchronous adjusting mechanism is disposed on the movable end and has a first force-bearing end and a second force-bearing end, which are respectively separated from the center of the synchronous adjusting mechanism by a rotating radius and remain at a synchronous state. The first motion element connects the first force-bearing end for generating a first force to push the first force-bearing end to move in a first force direction. The second motion element connects the second force-bearing end for generating a second force to push the second force-bearing end to move in a second force direction, such that the movable end can move with respect to the fixed end in a resultant force direction of the first force direction and the second force direction. In an embodiment, the lifting column has a linear extending direction, and the first motion element and the second motion element are substantially parallel to or form an angle with the linear extending direction of the lifting column.

According to another embodiment of the present invention, a linear lifting device including a lifting column, a synchronous adjusting mechanism and multiple motion elements is provided. The lifting column has a fixed end and a movable end. The synchronous adjusting mechanism is disposed on the movable end and has multiple force-bearing ends, which are respectively separated from the center of the synchronous adjusting mechanism by a rotating radius and remain at a synchronous state. The motion elements respectively connect the force-bearing ends for generating a force to push the force-bearing ends in a force direction, such that the movable end is pushed by the force to move with respect to the fixed end.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the invention are disclosed below with a number of embodiments. However, the disclosed embodiments are for explanatory and exemplary purposes only, not for limiting the scope of protection of the invention. In the following embodiments, two linear motion elements are used as an exemplification, the present invention can also be implemented by more than two linear motion elements. For example, two linear motion elements are disposed on each of the left and right sides of the lifting column; two linear motion elements are disposed on one side of the lifting column and a linear motion element is disposed on the other side of the lifting column; or four linear motion elements are respectively disposed on each of the front, rear, left and right sides of the lifting column. Besides, the linear motion element is only an example of embodiment, and other types (such as rotary, spiral or extendable) of motion elements can also be used the present invention, and the present invention does not have specific restrictions regarding the said design.

Figure 1A:
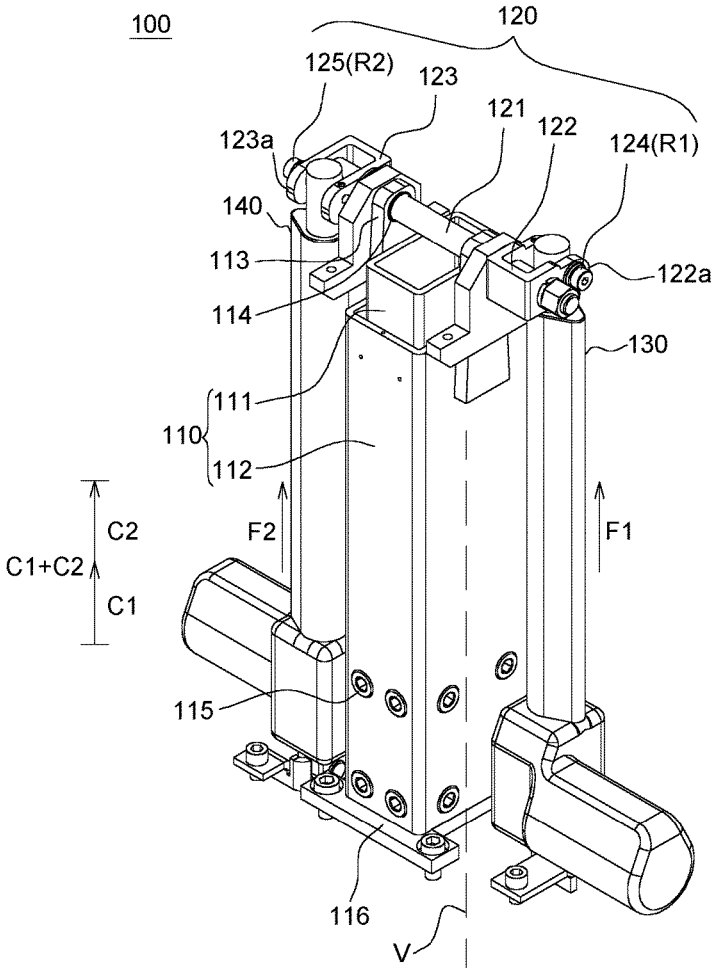
FIGS. 1A, 1B and 1C respectively are a 3D view, a side view and a top view of a linear lifting device according to an embodiment of the present invention.
Figure 1B:
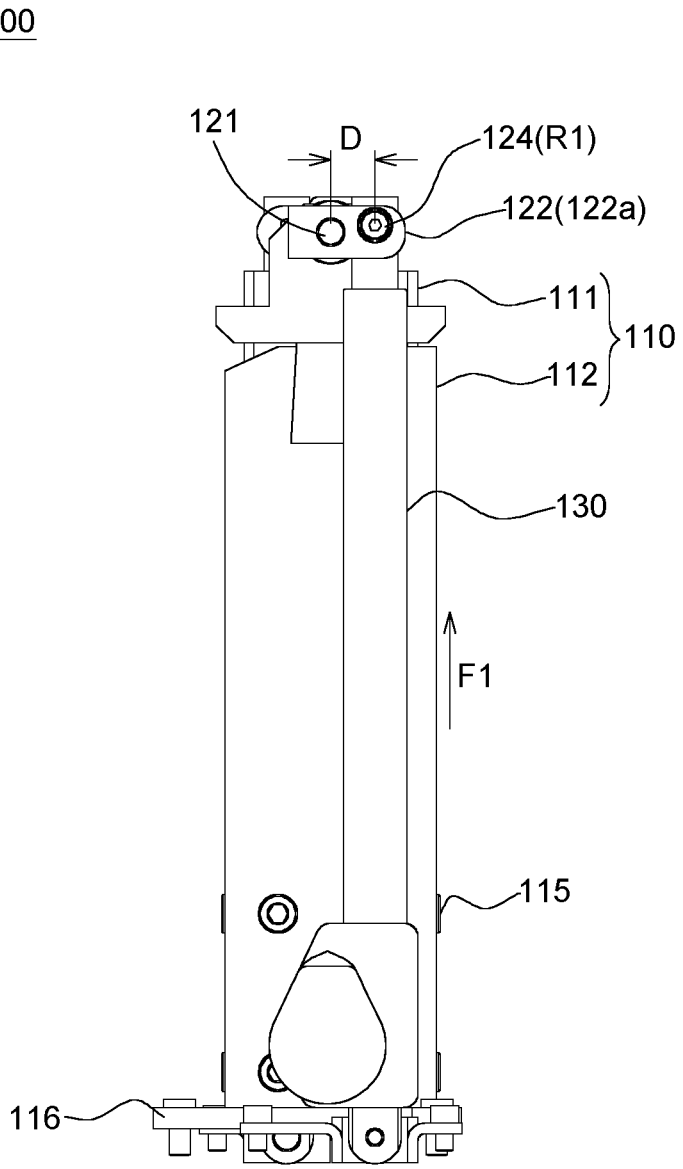
Figure 1C:
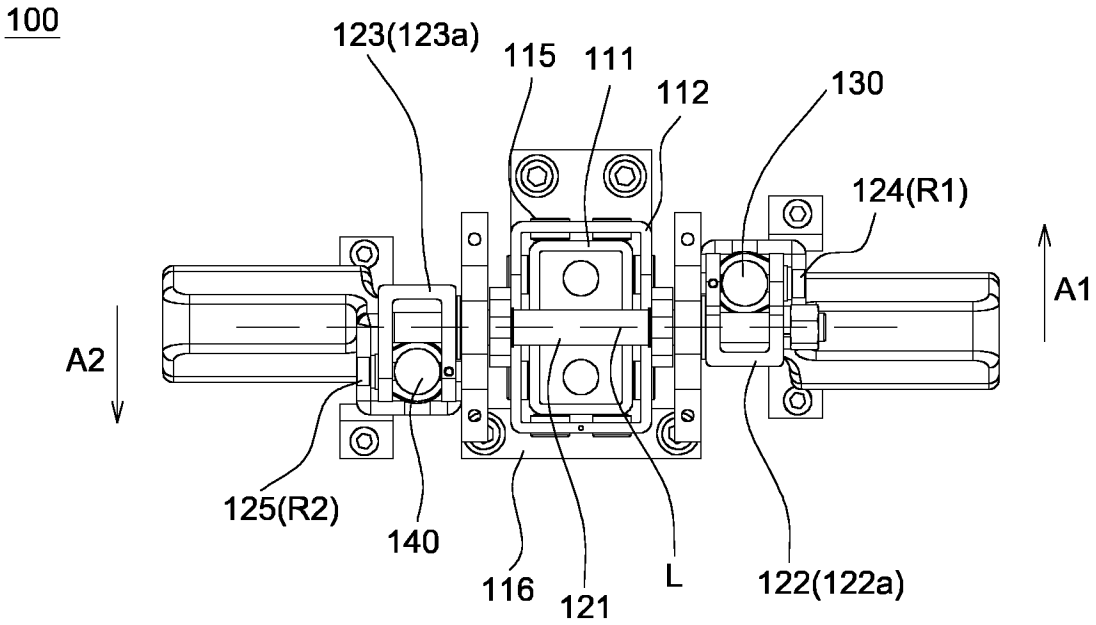

Refer to FIGS. 1A, 1B and 1C. In an embodiment of the present invention, the linear lifting device 100 includes a lifting column 110, a synchronous adjusting mechanism 120, a first linear motion element 130 and a second linear motion element 140. The lifting column 110 can be composed of a first column 111 and a second column 112 whose sizes and shapes match each other. The second column 112 is located inside the first column 111, and the height of the lifting column 110 can be changed when the second column 112 moves upwards or downwards with respect to the first column 111.

In an embodiment, the first column 111 of the lifting column 110 is fixed (the bottom of the first column 111 is a fixed end 116), but the second column 112 can move upwards or downwards with respect to the first column 111 (the top 113 of the second column 112 is a movable end). In another embodiment (not shown), the second column 112 of the lifting column 110 is fixed, but the first column 111 can move upwards or downwards with respect to the second column 112. In another embodiment, the lifting column 110 can be composed of a fixed column and multiple movable columns, such that the height of the lifting column 110 is flexible and can be increased more and more, and the present invention does not have specific restrictions regarding the said design.

Apart from the above two operation methods, the present invention can use other linear lifting method, and is not subjected to specific restrictions. To avoid the first column 111 and the second column 112 tilting during the ascending or descending process, multiple gap pads 115, formed of such as rubber or springs, can be interposed between the first column 111 and the second column 112, such that the first column 111 and the second column 112 can maintain linear motion during the ascending or descending process. The gap pads 115 can absorb the lateral force generated the lifting column 110 during the ascending or descending process and avoid the lifting column 110 wobbling.

Refer to FIGS. 1A, 1B and 1C. The synchronous adjusting mechanism 120 is disposed on the top 113 of the second column 112 (the top 113 of the second column 112 is a movable end). The synchronous adjusting mechanism 120 includes a central rotation shaft 121, a first moving shaft 124 and a second moving shaft 125. The push rod of the first linear motion element 130 is connected to the first moving shaft 124 of the synchronous adjusting mechanism 120 (that is, the first force-bearing end R1) and is disposed on one side of the lifting column 110. The push rod of the second linear motion element 140 is connected to the second moving shaft 125 of the synchronous adjusting mechanism 120 (that is, the second force-bearing end R2) and is disposed on the other side of the lifting column 110. The first moving shaft 124 and the second moving shaft 125 are basically parallel to the central rotation shaft 121, and are respectively disposed on two opposite sides of the central rotation shaft 121.

The first linear motion element 130 and the second linear motion element 140 can be realized by two electric linear driving devices. When the push rod of the first linear motion element 130 is driven by electricity to generate a first force, the first moving shaft 124 of the synchronous adjusting mechanism 120 (that is, the first force-bearing end R1) is driven to move in a first force direction F1. Also, when the push rod of the second linear motion element 140 is driven by a motor to generate a second force, the second moving shaft 125 of the synchronous adjusting mechanism 120 (that is, the second force-bearing end R2) is driven to move in a second force direction F2.

In an embodiment, the first force direction F1 and the second force direction F2 are substantially parallel to the linear extending direction V of the lifting column 110 during the ascending or descending process. Refer to FIG. 1A. Since the first force C1 and the second force C2 almost do not generate any horizontal components when being lifted vertically, the resultant force (C1+C2) of the first force C1 and the second force C2 is substantially equivalent to the sum of the absolute values of the first force C1 and the second force C2.

Figure 2A:
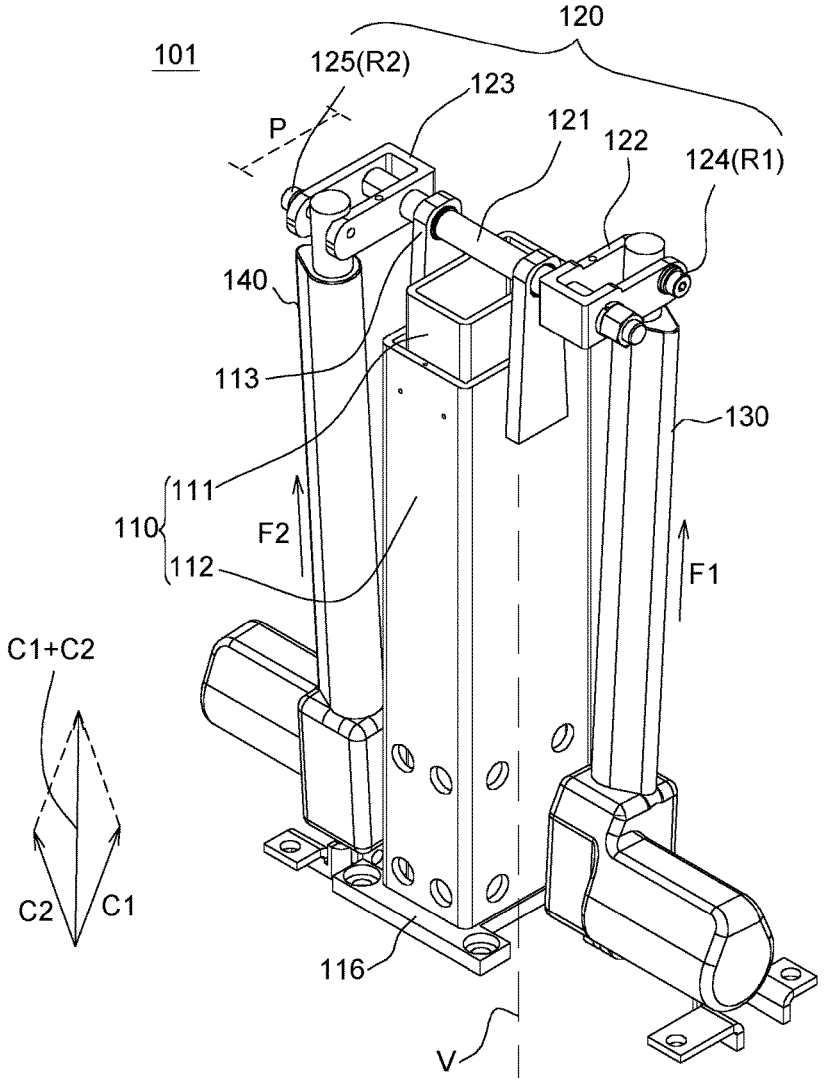
FIG. 2A is a schematic diagram of a linear lifting device in a synchronous state according to an embodiment of the present invention.
Figure 2B:
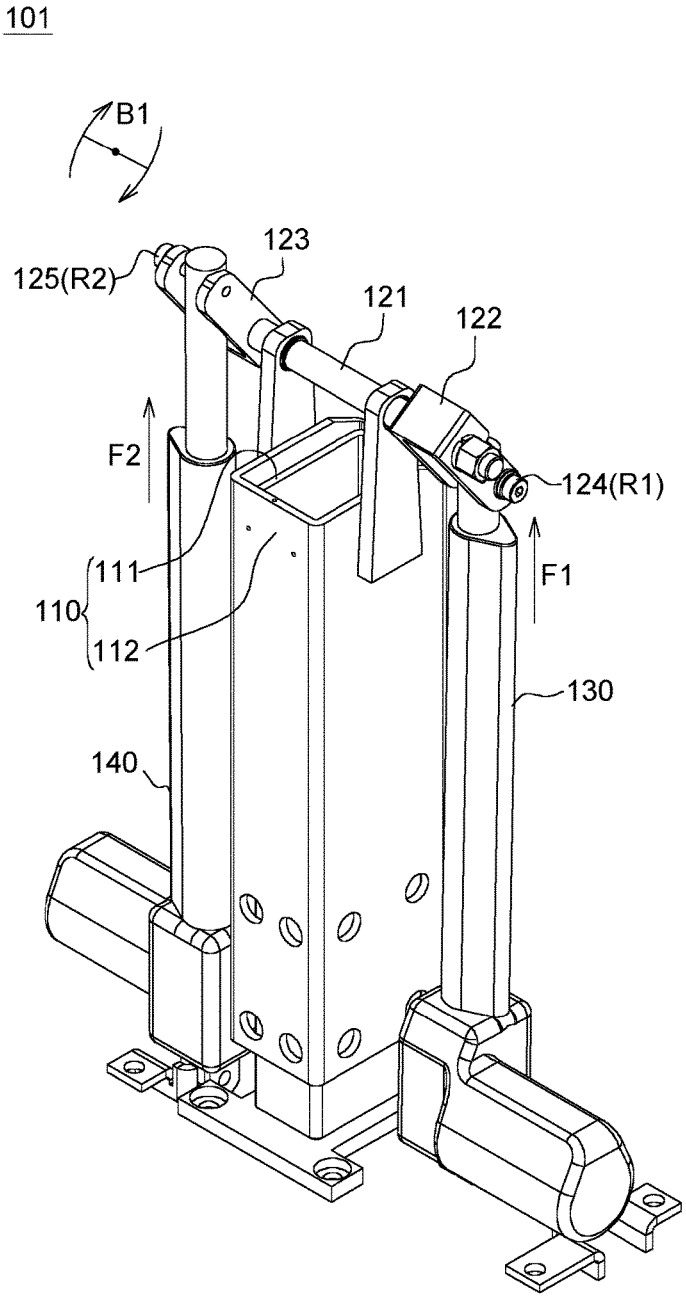
FIGS. 2B and 2C respectively are a schematic diagram of a linear lifting device tilting when in a non-synchronous state according to an embodiment of the present invention.
Figure 2C:
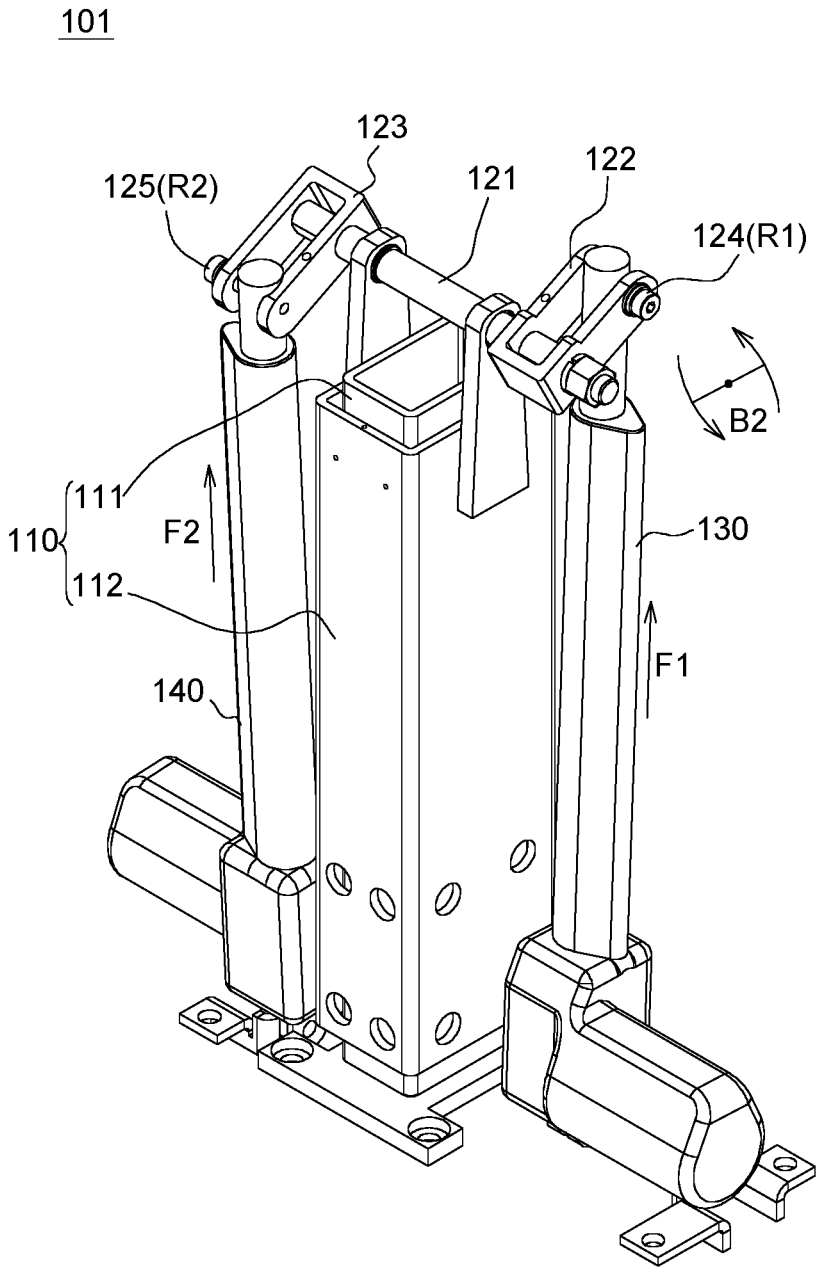

Refer to FIGS. 2A, 2B and 2C. In another embodiment, the first force direction F1 and the second force direction F2 form an angle of 5~30° with the linear extending direction V of the lifting column 110. Since the horizontal components generated by the first force C1 and the second force C2 have the same magnitude but inverse directions, the horizontal components are offset and only the upward vertical components are left. Therefore, the resultant force of the first force C1 and the second force C2 being (C1+C2) is substantially equivalent to the sum of the absolute values of the vertical component of the first force C1 and the vertical component of the second force C2.

The central rotation shaft 121 is rotatably disposed on the movable end (that is, the top 113 of the second column 112). For example, the bearing 114 of the central rotation shaft 121 is disposed in the opening of the top 113, such that the central rotation shaft 121 can pass through the top 113 and rotate. The two ends of the central rotation shaft 121 have a first bushing 122 and a second bushing 123, which are respectively located on two opposite sides of a length extending direction L of the central rotation shaft 121.

That is, the first bushing 122 has a first arm 122*a* extended from the center of the central rotation shaft 121 in the first direction A1 (perpendicular to the length extending direction L of the central rotation shaft 121); the second bushing 123 has a second arm 123*a* extended from the center of the central rotation shaft 121 in the second direction A2 (perpendicular to the length extending direction L of the central rotation shaft 121). The first arm 122*a* has a rotating radius D with respect to the center of the central rotation shaft 121; the second arm 123*a* also has a rotating radius D with respect to the center of the central rotation shaft 121.

As disclosed above, the first direction A1 inverse to the second direction A2, and the rotating radius D of the first arm 122*a* is basically equivalent to the rotating radius D of the second arm 123*a*, such that the first arm 122*a* and the second arm 123*a* are respectively protruded from two opposite sides of the central rotation shaft 121 at an equal distance. That is, the first moving shaft 124 and the second moving shaft 125 are respectively located on two opposite sides of the central rotation shaft 121 through the first arm 122*a* and the second arm 123*a*.

The first moving shaft 124 is disposed on the first arm 122*a* of the first bushing 122 and is rotatably connected to the first linear motion element 130, and the first force-bearing end R1 is located on the first moving shaft 124, therefore the first linear motion element 130 can drive the first moving shaft 124 (that is, the first force-bearing end R1) to move in a first force direction F1. Moreover, the second moving shaft 125 is disposed on the second arm 123*a* of the second bushing 123 and is rotatably connected to the second linear motion element 140, and the second force-bearing end R2 is located on the second moving shaft 125, therefore the second linear motion element 140 can drive the second moving shaft 125 (that is, the second force-bearing end R2) to move in a second force direction F2.

It should be noted that the first force-bearing end R1 and the second force-bearing end R2 remain at a synchronous state. That is, when the first force and the second force have the same magnitude and are synchronized, the first force-bearing end R1 and the second force-bearing end R2 can concurrently move upward or downward. Meanwhile, the lifting column 110 receives twice the force, and therefore can move upward or downward at twice the speed to increase efficiency.

Suppose one linear motion element provides a force of 3500 N and moves at a speed of 7 mm/s. Then, two linear motion elements can generate twice the force (approximately 7000 N), and can move at twice the speed at a constant speed (approximately 14 mm/s). Therefore, the linear lifting device 100 of the present embodiment provides a larger force and moves at a faster speed, and therefore can better satisfy market requirements.

Refer to the linear lifting device 101 of FIG. 2A. In an embodiment of the present invention, when the first force C1 and the second force C2 have the same magnitude and are synchronized, the first force-bearing end R1 and the second force-bearing end R2 receive a force at the same time point and are on the same horizontal surface P, the first force-bearing end R1 and the second force-bearing end R2 can concurrently move upward or downward.

Refer to FIGS. 2B and 2C. When the first force C1 and the second force C2 have the same magnitude but are not synchronized, the first force-bearing end R1 and the second force-bearing end R2 do not move synchronously on the same horizontal surface P. For example, the first force-bearing end R1 receives a first force C1 at a first time point, the second force-bearing end R2 receives a second force C2 at a second time point, and the first time point is earlier than or latter than the second time point. Meanwhile, after the synchronous adjusting mechanism 120 rotates for an angle with respect to the lifting column 110 and makes the first force-bearing end R1 and the second force-bearing end R2 tilt to an inclined plane B1 or B2 from a horizontal plane P, the first force-bearing end R1 and the second force-bearing end R2 will be synchronized again.

Refer to FIG. 2B. When the second force-bearing end R2 receives a force earlier than the first force-bearing end R1, the second bushing 123 is driven upward and pushes the second force-bearing end R2 to a position higher than the movable end. When the second bushing 123 is driven upward, the central rotation shaft 121 rotates such that the first bushing 122 rotates for an angle, and the first moving shaft 124 also rotates for the same angle to compensate the height difference between the first force-bearing end R1 and the second force-bearing end R2 which arises when the first force-bearing end R1 and the second force-bearing end R2 are not synchronized. After the first force-bearing end R1 and the second force-bearing end R2 tilt to an inclined plane B1 from the horizontal plane P (due to the height difference) and are in a force balance, the first force-bearing end R1, the second force-bearing end R2 and the central rotation shaft 121 together are moved upward synchronously such that the lifting column 110 will not generate pendulum effect which would otherwise be caused by the lateral force.

Refer to FIG. 2C. When the second force-bearing end R2 receives a force latter than the first force-bearing end R1, the first bushing 122 is driven upwards and pushes the first force-bearing end R1 to a position higher than the movable end. When the first bushing 122 is driven upward, the central rotation shaft 121 rotates such that the second bushing 123 rotates for an angle, and the second moving shaft 125 also rotates for the same angle to compensate the height difference between the first force-bearing end R1 and the second force-bearing end R2. After the first force-bearing end R1 and the second force-bearing end R2 tilt to an inclined plane B2 from the horizontal plane P (due to the height difference) and are in a force balance, the first force-bearing end R1, the second force-bearing end R2 and the central rotation shaft 121 together are moved upward synchronously such that the lifting column 110 will not generate pendulum effect which would otherwise be caused by the lateral force.

According to the linear lifting device disclosed in above embodiments of the present invention, through the coordination of the synchronous adjusting mechanism, the displacement error generated by linear motion elements can be adjusted, such that two or more than two linear motion elements, despite having displacement error, still can be moved upward or downward synchronously, pendulum effect caused by the lateral force can be reduced, resistance of the lifting column during motion can be reduced, and the pushing force can be effectively increased. Besides, as the pushing force of the linear lifting device is increased, the upward or downward moving speed is also increased. Therefore, the linear lifting device has a larger pushing force and faster moving speed than the hydraulic linear motion element and better satisfies market requirements.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A linear lifting device, comprising:

a lifting column having a fixed end and a movable end;

a synchronous adjusting mechanism disposed on the movable end, wherein the synchronous adjusting mechanism has a first force-bearing end and a second force-bearing end, and the first and second force-bearing ends are respectively separated from a center of the synchronous adjusting mechanism by a rotating radius and remain at a synchronous state;

a first motion element connecting the first force-bearing end for generating a first force to push the first force-bearing end to move in a first force direction; and a second motion element connecting the second force-bearing end for generating a second force to push the second force-bearing end to move in a second force direction, such that the movable end moves with respect to the fixed end in a resultant force direction of the first force direction and the second force direction.

2. The linear lifting device according to claim 1, wherein the synchronous adjusting mechanism comprises:

a central rotation shaft rotatably disposed on the movable end, wherein a first bushing and a second bushing are disposed on two ends of the central rotation shaft respectively, and are located on two opposite sides of a length extending direction of the central rotation shaft respectively;

a first moving shaft disposed on the first bushing, wherein the first moving shaft is rotatably connected to the first motion element, and the first force-bearing end is located on the first moving shaft; and a second moving shaft disposed on the second bushing, wherein the second moving shaft is rotatably connected to the second motion element, and the second force-bearing end is located on the second moving shaft, wherein, the first moving shaft and the second moving shaft are parallel to the length extending direction of the central rotation shaft.

3. The linear lifting device according to claim 2, wherein the first bushing has a first arm extended from the center of the central rotation shaft in a first direction, the second bushing has a second arm extended from the center of the central rotation shaft in a second direction, the first direction and the second direction are inverse to each other and perpendicular to the central rotation shaft.

4. The linear lifting device according to claim 3, wherein the first moving shaft is disposed on the first arm, the second moving shaft is disposed on the second arm, and the first moving shaft and the second moving shaft are located on two opposite sides of the central rotation shaft at an equal distance.

5. The linear lifting device according to claim 1, wherein the first force direction and the second force direction are substantially are substantially parallel to the resultant force direction.

6. The linear lifting device according to claim 1, wherein the first force direction and the second force direction form an angle with the resultant force direction.

7. The linear lifting device according to claim 1, wherein the lifting column has a linear extending direction, and the first motion element and the second motion element are substantially parallel to or form an angle with the linear extending direction of the lifting column.

8. The linear lifting device according to claim 1, wherein the first and second motion elements are electric linear driving devices.

9. The linear lifting device according to claim 1, wherein when the first force-bearing end receives the first force at a first time point, the second force-bearing end receives the second force at a second time point, and the first time point is earlier or latter than the second time point, such that the first force-bearing end and the second force-bearing end do not be synchronized on a horizontal plane; after the synchronous adjusting mechanism rotates for an angle with respect to the movable end and makes the first force-bearing end and the second force-bearing end tilt to an inclined plane from the horizontal plane, such that the first force-bearing end and the second force-bearing end can be synchronized again.

10. The linear lifting device according to claim 9, wherein when the second time point of the second force-bearing end is earlier than the first time point of the first force-bearing end, the second force-bearing end is pushed by the second motion element to a position higher than the movable end; wherein when the second time point of the second force-bearing end is latter than the first time point of the first force-bearing end, the first force-bearing end is pushed to a position higher than the movable end by the first motion element.

11. A linear lifting device, comprising:

a lifting column having a fixed end and a movable end;

a synchronous adjusting mechanism disposed on the movable end, wherein the synchronous adjusting mechanism has a plurality of force-bearing ends, and the force-bearing ends are respectively separated from a center of the synchronous adjusting mechanism by a rotating radius and remain at a synchronous state; and a plurality of motion elements respectively connecting the force-bearing ends for generating a pushing force to push the force-bearing ends, such that the movable end is pushed by the force to move with respect to the fixed end.

12. The linear lifting device according to claim 11, wherein the lifting column has a linear extending direction, and the motion elements are substantially parallel to or form an angle with the linear extending direction of the lifting column.

13. The linear lifting device according to claim 11, wherein the motion elements are electric linear driving devices.

14. The linear lifting device according to claim 11, wherein when the force-bearing ends receive the pushing force at different time points, the force-bearing ends do not be synchronized on a horizontal plane; after the synchronous adjusting mechanism rotates for an angle with respect to the movable end and makes the force-bearing ends tilt to an inclined plane from the horizontal plane, the force-bearing ends can be synchronized again.

15. The linear lifting device according to claim 11, wherein the quantity of motion elements is two, and the two motion elements are respectively located on two opposite sides of the lifting column.

16. The linear lifting device according to claim 11, wherein the quantity of motion elements is three, one elements is located on a first side of the lifting column, the other two motion elements are located on a second side of the lifting column, and the first side and the second side are opposite to each other.

17. The linear lifting device according to claim 11, wherein the quantity of motion elements is four, two motion elements are located on a first side of the lifting column, the other two motion elements are located on a second side of the lifting column, and the first side and the second side are opposite to each other.

18. The linear lifting device according to claim 11, wherein the fixed end is a fixed column, the movable end includes at least a movable column, the shape of the movable end matches with the shape of the fixed end, and the movable end moves linearly with respect to the fixed end.

19. The linear lifting device according to claim 11, wherein a resultant force of each motion element acting on the lifting column in the linear extending direction is equivalent to the pushing force, and each motion element forms an angle of 5~30° with the linear extending direction of the lifting column.

20. A linear lifting device, comprising:

a lifting column having a fixed end and a movable end;

a synchronous adjusting mechanism disposed on the movable end, wherein the synchronous adjusting mechanism has a first force-bearing end and a second force-bearing end, and the first and second force-bearing ends are respectively separated from a center of the synchronous adjusting mechanism by a rotating radius and remain at a synchronous state;

a first motion element connecting the first force-bearing end for generating a first force to push the first force-bearing end to move in a first force direction; and a second motion element connecting the second force-bearing end for generating a second force to push the second force-bearing end to move in a second force direction, wherein the lifting column has a linear extending direction, and the first motion element and the second motion element are substantially parallel to or form an angle with the linear extending direction of the lifting column.

* * * * *